United States Patent [19]

Itoh

[11] Patent Number: 4,875,306

[45] Date of Patent: Oct. 24, 1989

[54] DOOR APPARATUS

[76] Inventor: Mituru Itoh, No. 2-6, Inohana 3-chome, Chiba-shi, Chiba-ken, Japan

[21] Appl. No.: 210,694

[22] Filed: Jun. 23, 1988

[30] Foreign Application Priority Data

Dec. 21, 1987 [JP] Japan ..... 62-323453

[51] Int. Cl.[4] ..... E05D 15/56

[52] U.S. Cl. ..... 49/208; 49/260

[58] Field of Search ..... 49/260, 208

[56] References Cited

U.S. PATENT DOCUMENTS

| | | | |
|---|---|---|---|
| 752,413 | 2/1904 | Pitt et al. | 49/260 |
| 938,427 | 10/1909 | Malocsay | 49/260 X |
| 1,115,345 | 10/1914 | Steuernagel | 49/260 X |
| 2,143,704 | 1/1939 | Kufner | 49/260 X |

FOREIGN PATENT DOCUMENTS

| | | | |
|---|---|---|---|
| 43034 | 8/1926 | Norway | 49/260 |

*Primary Examiner*—James R. Brittain

*Attorney, Agent, or Firm*—Armstrong, Nikaido, Marmelstein, Kubovcik & Murray

[57] ABSTRACT

Disclosed is a novel door apparatus of the type wherein one door rotates while moving horizontally to the right and left, becomes parallel to the sidewall of an entrance, thereby being opened fully, then reverses in the original direction while moving horizontally and is then closed. The door apparatus of the invention is most suitable for an entrance having a limited width or for the handicapped or those who use a wheelchair because they have difficulty in passing through conventional swing type doors.

1 Claim, 9 Drawing Sheets

DOOR APPARATUS

BACKGROUND OF THE INVENTION

1. Field of the Invention

This invention relates generally to a door apparatus, and more particularly to a novel door apparatus of the type wherein one door rotates while moving horizontally to the right or left, opens fully while being parallel to the sidewall of an entrance, moves horizontally while reversing to the original direction and is thereafter closed.

2. Description of the Prior Art

The conventional doors have the structure wherein either the right or left side edge portion of the door is pivotally fitted to the sidewall of an entrance by hinges. Therefore, when one opens the door, the door swings greatly with the hinges being the support point. Since the door thus swings greatly, he must take a step backward when he pulls the door towards him. Generally, one passes through the door without opening it fully. In such a case, he must pass through while turning sideways.

Because the conventional door has the structure as described above, the door cannot be opened and closed smoothly and easily particularly by the handicapped or those who use a wheelchair and they have difficulty in passing through the door.

SUMMARY OF THE INVENTION

In order to eliminate the problems with the prior art doors described above, the present invention contemplates to provide a novel door apparatus of the type wherein one door rotates while moving horizontally to the right or left, opens fully while being parallel to the sidewall of an entrance, moves horizontally while reversing to the original direction and is thereafter closed, and which eliminates the trouble of taking a step backward or turning sideways when opening the door.

The above and other objects and novel features of the present invention will become more apparent from the following description when taken in conjunction with the accompanying drawings.

DESCRIPTION OF THE PREFERRED EMBODIMENTS

Figure 1:
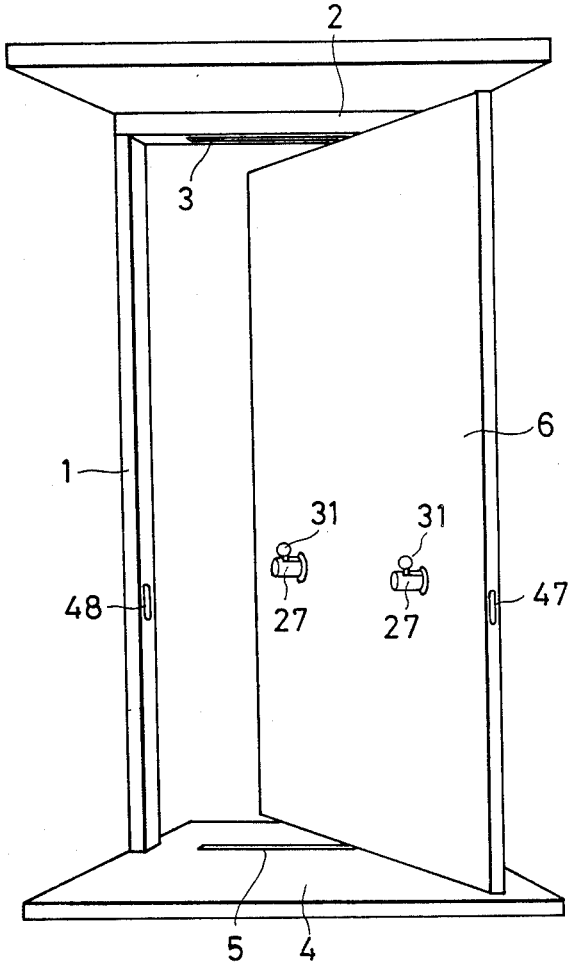
FIG. 1 is an overall perspective view of the door apparatus of the present invention.
Figure 2:
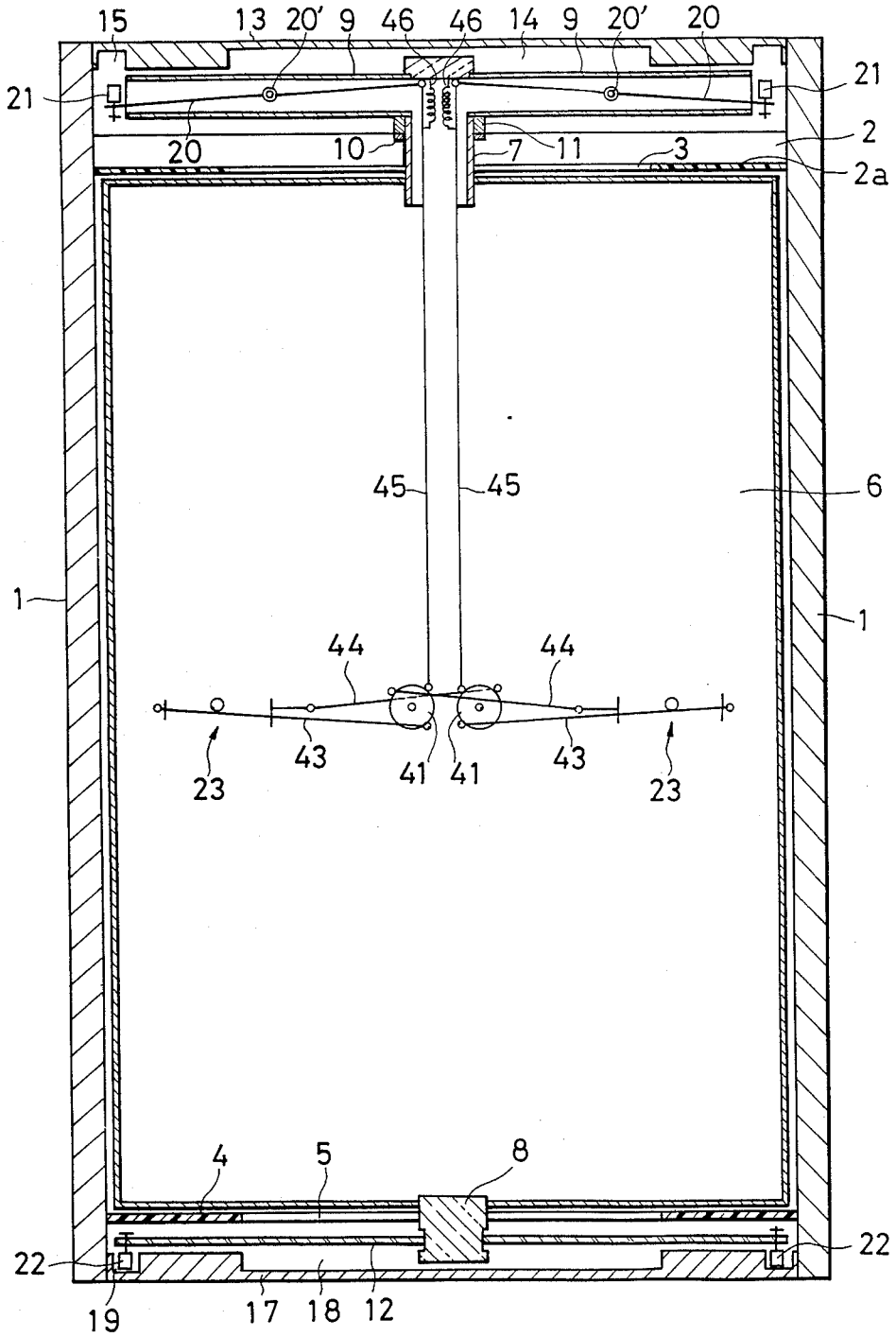
FIG. 2 is a central longitudinal sectional view showing a knob mechanism in simplification.
Figure 3:
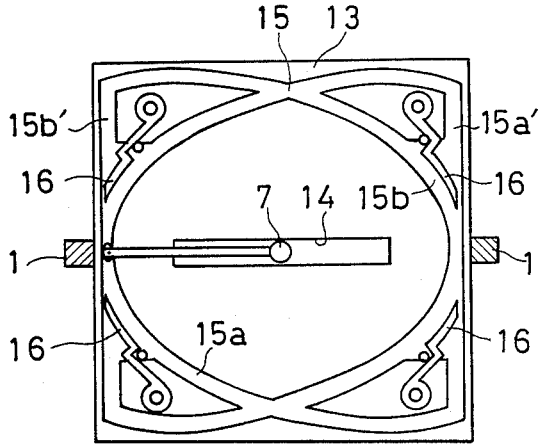
FIG. 3 is a bottom view of an upper guide plate.
Figure 4:
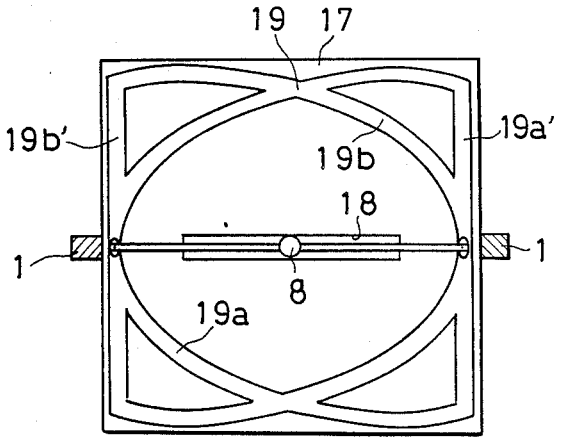
FIG. 4 is a top view of a lower guide plate.
Figure 5:
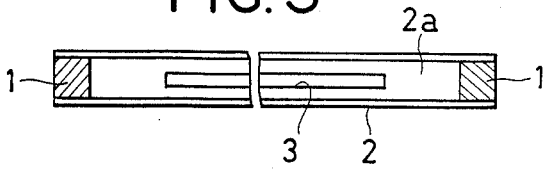
FIG. 5 is a plan view of a beam with part thereof being omitted.
Figure 6:
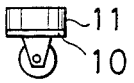
FIG. 6 is a side view of bed seat equipped with roller and a washer.
Figure 7:
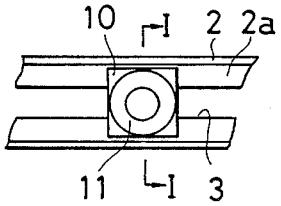
FIG. 7 is a plan view of a bed seat equipped with roller and a washer under the state where they are disposed on the beam.
Figure 8:
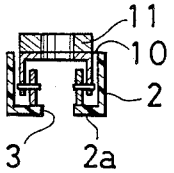
FIG. 8 is a sectional view taken along line I—I of FIG. 7.
Figure 9:
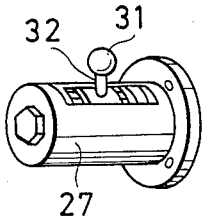
FIG. 9 is a perspective view of a knob portion.
Figure 10:
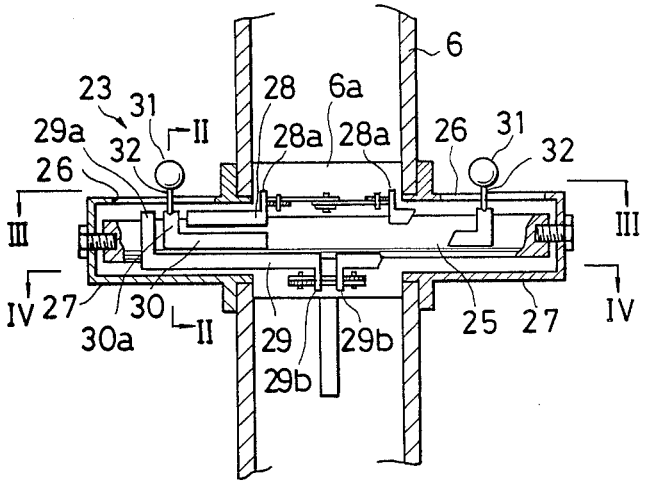
FIG. 10 is an enlarged longitudinal sectional view of a knob mechanism with part thereof being omitted.
Figure 11:
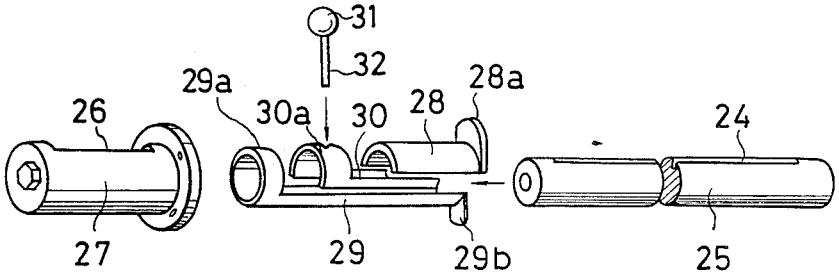
FIG. 11 is an exploded perspective view of the knob mechanism.
Figure 12:
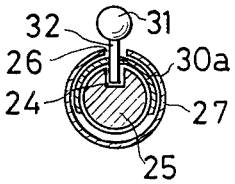
FIG. 12 is a sectional view taken along line II—II of FIG. 10.
Figure 13:
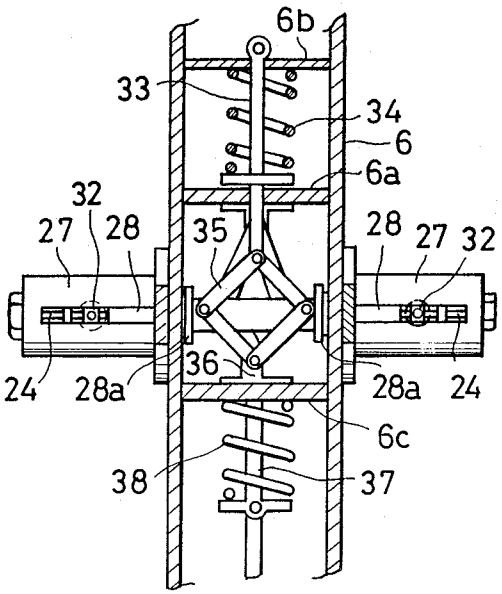
FIG. 13 is a sectional view taken along line III—III of FIG. 20.
Figure 14:
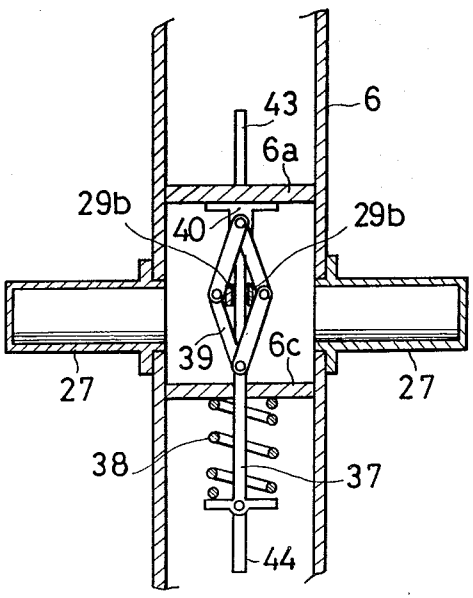
FIG. 14 is a sectional view taken along line IV—IV of FIG. 10.
Figure 15:
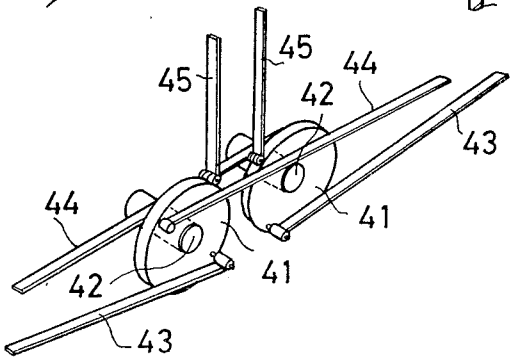
FIG. 15 is a perspective view of a connection rod and a rotary plate.
Figure 16:
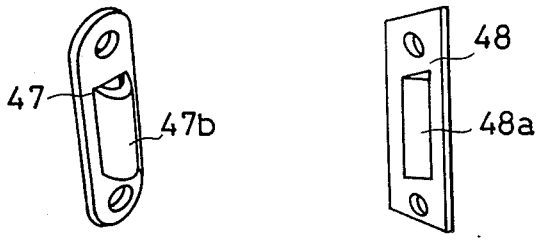
FIG. 16 is a perspective view of a door closing metal.
Figure 17:
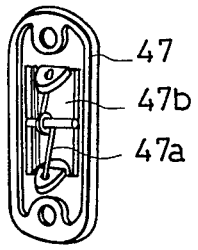
FIG. 17 is a perspective view of the door closing metal when viewed from the back of its member on one side.

In the drawings, reference numerals 1, 1 each represents a post disposed vertically on the sidewall of an entrance. Reference numeral 2 represents a beam which is extended near and between the upper end of the posts 1, 1 and has a u shaped longitudinal section. An elongated hole 3 having a predetermined length is bored on its bottom plate 2*a* in the longitudinal direction.

Reference numeral 4 represents a floor plate which is extended near and between the lower end of the posts 1, 1 and an elongated hole 5 having the same length as that of the elongated hole 3 described above is bored on the floor plate on the line that connects the posts 1, 1 to each other.

Reference numeral 6 represents a door disposed between the posts 1 and 1. This door is shaped as a hollow body.

Reference numerals 7 and 8 represent upper and lower support shafts fixed to the center of the door 6 in its transverse direction, respectively. The upper support shaft 7 is inserted through the elongated hole 3 of the beam 2 and the lower support shaft 8 is inserted through the elongated hole 5 of the floor plate 4. The upper support shaft 7 is hollow, and support frames 9 of an elevation lever 20, later to be described, are fixed orthogonally to the upper end of the support shaft 7 in parallel with the door 6. The center of the upper support shaft 7 in its axial direction is fixed to a washer 11 that slides on the upper surface of a bed seat 10 equipped with a roller that in turn moves on the bottom plate 2*a* and of the beam 2. A piece support plate 12 is fixed orthogonally to the lower end of the lower support shaft 8 in parallel with the door 6.

Reference numeral 13 represents a rectangular upper guide plate which is extended between the upper end of the posts 1 and 1. A linear guide groove 14 for the upper support shaft, which is in agreement with the elongated hole 3, is formed on the lower surface of the upper guide plate. Also, a piece guide groove 15 formed by superposing two stirrup-like grooves 15*a*, 15*b* is formed on the lower surface so that the linear portions 15*a*', 15*b*' of these grooves 15*a*, 15*b* face the posts 1, 1, respectively. A leaf spring 16 for limiting the moving direction of a piece is disposed on each linear portion 15*a*', 15*b*' of the piece guide groove 15.

Reference numeral 17 represents a rectangular lower guide plate which is fixed to the lower end of the posts 1, 1. A linear guide groove 18 for the lower support shaft which is in agreement with the elongated hole 5 described above is formed on the upper surface of the lower guide plate. Also, a piece guide groove 19 formed by superposing two stirrup-like grooves **19*a*, 19*b* is formed on the lower surface so that the linear portions 19*a*', 19*b*' of these grooves 19*a*, 19*b* face the posts 1 and 1**.

Reference numerals 20, 20 each represents a piece elevation lever which is pivoted rotatably in the vertical direction to the support frame 9, 9 at its center in the axial direction by a support shaft 20'. Reference numerals 21, 21 each represents a piece fitted to the outer end portion of each piece elevation lever 20, 20 in such a manner as to fit into the piece guide groove 15 when it is raised.

Reference numerals 22, 22 each represents a piece, which is pivotally fitted to the outer end part of the piece support plate 12 described above, and is fitted into the piece guide groove 19 also described above.

Reference numeral 23 represents a knob mechanism. Two knob mechanisms 23 are disposed at the right and left positions of the door 6 in its transverse direction.

The knob mechanism 23 consists of a shaft member 25 which is equipped with a key groove 24 in an axial direction on its apex and penetrates through the door 6 in the longitudinal direction, cylindrical covers 27, 27 which support the end portions of the shaft member 25, are fixed at the same positions at the front and back of the door 6 and are equipped with axial elongated holes 26 on their apexes, slide plates 28, 28 which are inserted slidably between the inner surface of the cylindrical covers 27, 27 and the upper surface of the shaft member 25, are equipped with a projection **28*a* at their inner end and have a semi-circular sectional shape, slide plates 29, 29 which are equipped with a vertical ring portion 29*a* fitting from outside to the shaft member 25 at their outer end and a vertical projection 29*b* at the inner end which is positioned more inwardly than the projection 28*a*, and are disposed in such a manner that their main body portion having a semicircular sectional shape slide along the lower surface of the shaft member 25, operation plates 30, 30 which have a portion 30*a* of a semicircular shape fitting between the outer end part of each slide plate 28, 28 and each slide plate 29, 29 and which slide along the shaft member 25 and operation rods 32, 32 which penetrate longitudinally through the portion 30*a* of the semicircular sectional shape of the operation plate 30, 30, whose lower end part is fitted into the key groove 24 of the shaft member 25 and equipped with knobs 31, 31 fixed to their upper end portions projecting from the elongated hole 26 of the cylindrical cover 27, 27**.

Reference numeral 33 represents an operation rod for raising the piece 21 when the knob 31 is pushed out. It is fitted horizontally to the door 6 in such a manner as to penetrate through the support walls **6*a*, 6*b* of the door 6 towards its outside, and moves in a direction orthogonal to the shaft member 25. The operation rod 33 is urged by a spring 34 towards the center of the door 6 and its inner end is connected to a pivot shaft at one of the corners of contractive rod 35 that are formed by connecting four connecting rods by pivotal shafts. The pivotal shaft which is diagonal to the pivotal shaft connecting the operation rod 33 of the contractive rod 35 is connected to a bracket 36 which is disposed on the support wall 6*c* on the opposite side to the support wall 6*a* described above while interposing the shaft member 25 between them. The other two corners of the contractive rod 35 come into contact with the projections 28*a*, 28*a* of the slide plates 28, 28**, respectively.

Since the operation rod 33 is normally urged towards the center portion of the door 6 by the coil spring 34 described above, the four connecting rods of the contractive rod 35 are normally contracted in the square form.

Reference numeral 37 represents an operation rod for raising the piece 21 on the opposite side to the knob 31 when the knob 31 is pulled. It is fitted horizontally in such a manner as to penetrate through the support wall **6*c* of the door 6 and to extend inwardly towards the door 6, and moves in a direction orthogonal to the shaft member 25. The operation rod 37 is urged by the coil spring 38 so as to move towards the center of the door 6 and its inner end is connected to the pivotal shaft at one of the corners of the contractive rod 39 consisting of four connecting rods that are connected by pivotal shafts. The pivotal shaft of the corner diagonal to the corner of the operation rod 37 is connected to the bracket 40 disposed on the support wall 6*a*. The other two corners of the contractive rod 39 come into contact with the projections 29*b*, 29*b* of the slide plates 29, 29**, respectively.

Since the operation rod 37 is normally biased by the coil spring 38 towards the center of the door 6, the four connecting rods of the contractive rod 37 are normally extended in the diamond shape.

Reference numerals 41, 41 represent rotary plates that are supported rotatably in the vertical direction by shafts 42, 42 at substantially the center inside the door 6.

Reference numerals 43, 43 represent connecting rods. One of the ends of each connecting rod is pivotally connected to the tip of the operation rod 33 while the other end is pivotally connected to a position of the rotary plate 41 which is inwardly and diagonally more downward than the shaft 42, 42.

Reference numerals 44, 44 represent connecting rods. One of the ends of each connecting rod 44 is pivotally connected to the tip of the operation rod 37 while the other end is connected pivotally to the rotary plate 41, 41 on the remote side in such a manner as to cross the other end of the other connecting rod 44. Incidentally, the position of pivotal connection of the connecting rod 44 is outwardly and diagonally more upward than the shaft 42, 42.

Reference numerals 45, 45 represent connecting rods. One of the ends of each connecting rod 45 is pivotally connected to the rotary plate 41 at a position which is inwardly and diagonally more upward than the shaft 42 and the other end is pivotally connected to the inner end of the piece elevation lever 20 described above.

Reference numerals 46, 46 represent coil springs which normally bias the connecting rods 45, 45 upward.

Reference numerals 47, 48 represent metals for keeping the door under the closed state. The metal 47 is equipped with an anchor projection **47*b* which can come in and out by a spring 47*a* and the metal 48 is equipped with a recess 48*a* into which the anchor projection 47*b* fits. These metals 47, 48 are fitted to the right and left side surfaces of the door 6 and to the opposed surfaces of the posts 1, 1**, respectively.

Next, the operation of the present apparatus having the construction described above will be explained.

Figure 18:
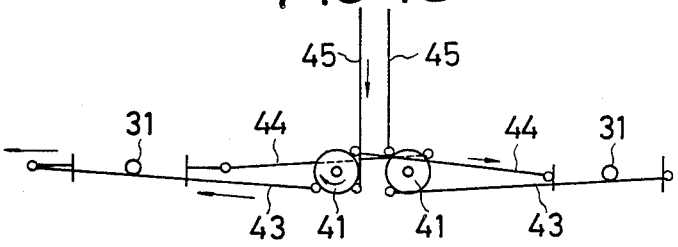
FIG. 18 is an explanatory view useful for explaining the operation of the connecting rod and the rotary plate when a left knob is pushed.
Figure 19:
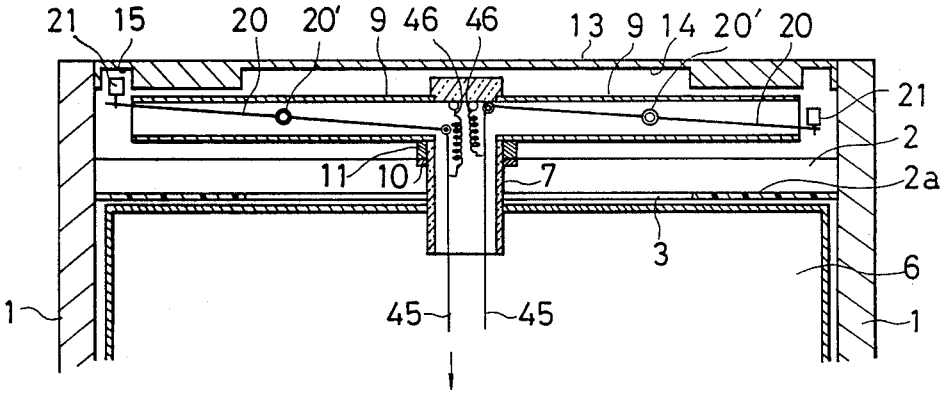
FIG. 19 is an explanatory view useful for explaining the operation of the upper part of the apparatus when the left knob is pushed.

When one approaches to the door 6 and pushes it out by gripping the knob 31 on the left side in the drawing, the slide plate 28 is pushed inward by the operation plate 30 and slides on the shaft member 25. Therefore, the projection 28*a* of the slide plate 28 pushes the contractive rod 35, causes its deformation and extends it in the direction orthogonal to the shaft member 25. In consequence, the operation rod 33 is pushed out of the left of the door 6 against the force of the coil spring 34, and the connecting rod 43 connected pivotally to the tip of the operation rod 33 is pulled in the moving direction of the operation rod 33 due to its movement. The rotary plate 41 on the left side in the drawing, which is connected to the other end of the connecting rod 43, rotates clock-wise in the drawing. Due to the rotation of this rotary plate 41, the connecting rod 45 is pulled down against the force of the coil spring 46 and pulls down the inner end portion of the piece elevation lever 20 on the left side in the drawing which is connected to the upper end of the connecting rod 45. Accordingly, the outer end portion of the piece elevation lever 20 rises and the piece 21 fitted pivotally thereto fits into the piece guide groove 15 of the upper guide plate 13 (FIGS. 18 and 19).

Figure 20:
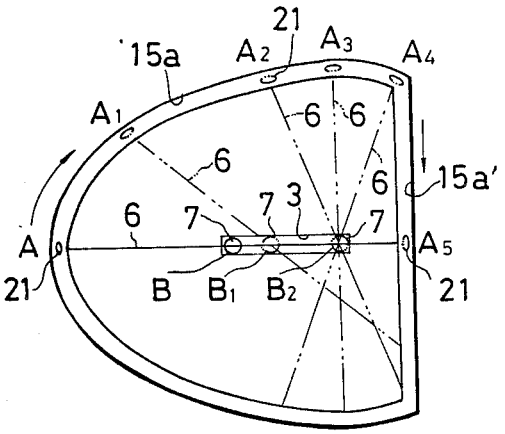
FIG. 20 is an explanatory view useful for explaining the moving orbit of the door.

When one moves forward while pushing the knob 31, the door 6 opens while describing the moving orbit shown in FIG. 20 due to the movement of its support shaft 7 inside the elongated hole 3 on the beam 2 and to the movement of the upper guide plate 13 of the piece 21 inside the piece guide groove 15, and then door 6 reverses. Incidentally, the guide groove 15 and the door 6 are shown simplified in FIG. 20 for easier understanding.

When closed, the door 6 is at the position represented by solid line. At this time, the piece 21 is at the position A while the support shaft 7 is at the position B. When the piece 21 reaches the position $A_1$ along the arc-shaped guide groove 15*a*, the support shaft 7 moves to the position $B_1$ and the door moves rightward in the drawing while rotating. When the piece 21 reaches the position $A_2$, the support shaft 7 reaches the right end position $B_2$ of the elongated hole 3 and the door 6 further rotates. When the knob 31 is further pushed while the rightward movement of the support shaft 7 is checked, the piece 21 reaches the position $A_3$ and at this time, the door 6 is parallel to the sidewall of the entrance and is fully open.

When the knob 31 is further pushed, the piece 21 reaches the end position $A_4$ of the arcuate portion of the guide groove 15*a* and the door 6 starts reversing. Incidentally, the support shaft 7 is at the position $B_2$ and thereafter moves to the original position.

when the knob 31 is further pushed and the piece 21 reaches the position $A_5$ along the linear portion 15*a'* of the guide groove 15*a*, the door 6 reverses completely.

When the piece 21 moves along the linear portion 15*a* of the guide groove 15*a*, the support shaft 7 moves in the original direction of B while rotating clockwise in the drawing, so that the door 6 moves while rotating leftward.

Next, the case where the knob on the left side in the drawing is pulled will be described.

When the knob 31 on the left side is pulled, the ring 29*a* is pushed and the slide plate 29 slides outward along the shaft member 25. Due to the movement of the slide plate 29, the contractive rod 39 is opened by its projection 29*b* and then contracts. therefore, the operation rod 37 is pulled leftwardly outward relative to the door 6 against the force of the coil spring 38. As the operation rod 37 moves, the connecting rod 44 connected pivotally to its tip is pulled in the moving direction of the operation rod 37 and the rotary plate 41 on the right side in the drawing, whose other end portion is pivotally connected, rotates counter-clockwise in the drawing. With this rotation of the rotary plate 41, the connecting rod 45 is pulled down against the force of the coil spring 46 and pulls down the inner end portion of the piece elevation lever 20 on the right side in the drawing, which is connected to the upper end of the connecting rod 45.

Thereafter, the door 6 moves while rotating leftward in the reverse manner as when the knob 31 on the left side in the drawing is pushed, is fully open and thereafter reverses and closes fully.

The operation when the knob 31 on the right side is operated will be omitted.

Since the construction and operation of the present apparatus are as described above, the push operation of the knob on the left side is equal to that of the knob on the right side and vice versa. Therefore, the door operation can be made by use of either the right or left knob 31 or either the inner or outer knob 31.

Next, another embodiment of the present invention will be described with reference to FIGS. 21 and 22.

The difference of this embodiment from the fore-going embodiment is that while the fore-going embodiment uses various connecting rods and rotary plates for rotating the piece elevation levers 20, 20, this embodiment uses electromagnets.

Figure 21:
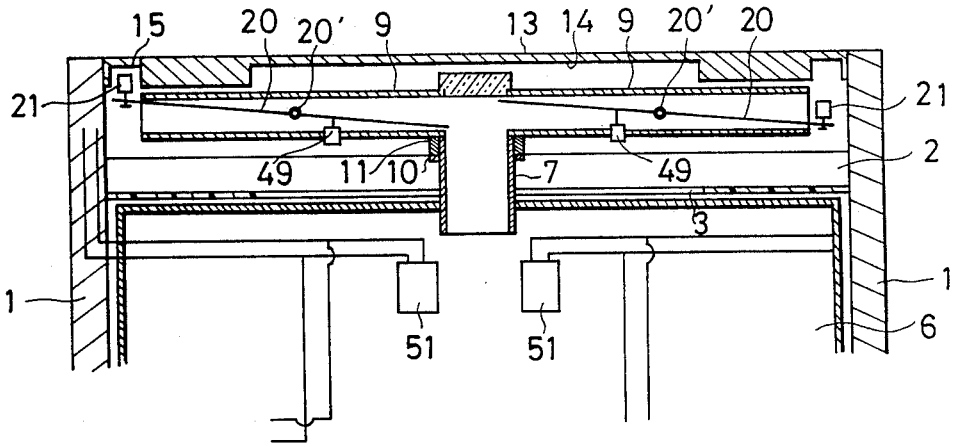
FIGS. 21 and 22 illustrate another embodiment of the present invention which employs electromagnets for rotating the elevation levers.
Figure 22:
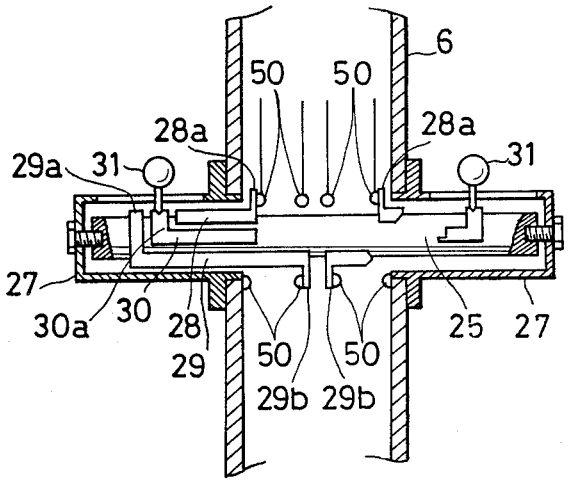

In FIG. 21, reference numerals 49, 49 represent electromagnets whose operation members are pivotally connected to the piece elevation levers 20, 20, respectively, and which are fixed to the support rods 9, 9. Reference numerals 50, 50 represent electric contacts for opening and closing the electric circuit (not shown) of the electromagnets 49, 49 and fitted in such a manner as to come into contact when the knob 31 in the knob mechanism 23 is pushed or pulled and to open the electric circuit. Reference numerals 51, 51 represent capacitors disposed inside the electric circuit of the electromagnet 49, 49.

Incidentally, the operation of the electromagnet 49, 49 by use of the contact 40, 40 can be easily accomplished by use of a known electric circuit.

In this embodiment, when the left knob 31 is pushed, the power is supplied to the left electromagnet 49 as shown in FIG. 21 to pull down the inner end side of the piece elevation lever 20 so that the piece 21 fits into the piece guide groove 15 of the upper guide plate 13.

The subsequent movement of the door is the same as that of the fore-going embodiment.

When the knob 31 is pulled, the right piece elevation lever 20 rotates in the reverse manner to the above and the subsequent door movement is also the same as that of the fore-going embodiment.

Since the door apparatus of the present invention has the construction and operation as described above, one door rotates while moving horizontally to the right and left, is fully open while being in parallel with the sidewall of the entrance, then reverses in the original direction, moves horizontally and is then closed. Therefore, it is not necessary for one to take a step backward or to turn sideways unlike the conventional swing type doors, and he can move straight as such. Therefore, even the handicapped or those who use a wheelchair can pass smoothly through the door. Moreover, since the door opens fully in such a manner as to become in parallel with the sidewall of the entrance, the door apparatus of the present invention can be used most suitably for a narrow passage. Furthermore, since the door of the present invention can be opened fully and rapidly by limited force of operation, one can pass smoothly through the door. In addition, the rhythmic door operation is indeed pleasing, and the door can be opened and closed completely by only one hand without the need of changing the grip of the knob.

While the invention has been particularly shown and described in reference to preferred embodiments thereof, it will be understood by those skilled in the art that changes in form and details may be made therein without departing from the spirit and scope of the invention.

What is claimed is:

1. A door apparatus, comprising:

two posts vertically fitted onto a sidewall of an entrance;

a beam disposed within a proximity of an upper end portion of said two posts, said beam having a U-shaped longitudinal sectional shape and equipped on a bottom plate thereof with an elongated hole having a predetermined length in a longitudinal direction;

a substantially rectangular upper guide plate disposed at an upper part of said beam, wherein said upper guide plate has a lower surface, a linear support shaft guide groove on said lower surface having a direction and a length substantially equal to said elongated hole of said beam, and a piece guide groove formed on said lower surface by superposing two strips of stirrup-like grooves having a linear portion in such a manner that the linear portion of each of said stirrup-like grooves faces each of said posts;

a floor plate fitted in the proximity of a lower end portion of said posts, and wherein said floor plate has an elongated hole having a direction and a length substantially equal to those of said elongated hole of said beam;

a rectangular lower guide plate fitted to a lower portion of said floor plate, and wherein said lower guide plate has an upper surface, a plurality of piece guide grooves on said upper surface, each piece guide groove has substantially the same shape as that of said piece guide groove of said upper guide plate and a lower support shaft guide groove on said upper surface having substantially the same shape as that of said upper support shaft guide groove;

upper and lower support shafts fixed to the center of a hollow door and disposed between said two posts in the transverse direction of said door;

said upper support shaft being hollow and inserted through said elongated hole of said beam and supported by said beam in such a manner as to be movable while being rotated along said elongated hole of said beam;

piece elevation levers each having a support frame fixed at right angles to an upper end of said upper support shaft in parallel with said door, said piece elevation levers being fitted rotatably in the vertical direction to the center of said support frame in the longitudinal direction thereof;

two member pieces fitted to outer end portions of said piece elevation levers and fitted into said piece guide grooves of said upper guide plate when said member pieces rise, wherein said lower support shaft being inserted into said elongated plate of said floor plate;

a piece support plate fixed vertically to a lower end portion of said lower support shaft in parallel with said door;

other pieces fitted pivotally to outer end portions of said piece support plate and fitted into said piece guide grooves of said lower guide plate;

a knob mechanism which comprises:

a shaft member having an axial elongated groove on an apex thereof, wherein said shaft member penetrates through said door in the longitudinal direction;

cylindrical cover means for supporting an end portion of said shaft member, said cylindrical cover means being fixed to the same front or rear position of said door and equipped with an elongated hole in an axial direction on the apex thereof;

slide plates, each being slidably fitted between an inner surface of said cylindrical cover means and an upper surface of said shaft member, each slide plate being equipped with a projection extending vertically at an inner end thereof and having a semi-circular sectional shape;

other slide plates, each being equipped at an outer end thereof with a ring which is fitted, from outside to said shaft member and at an inner end thereof, with a projection extending vertically, and having a main body portion which has a semi-circular sectional shape and slides along a lower surface of said shaft member, wherein said projection is more inward than said projection of said slide plate;

operation plates, each having a portion which has a semi-circular sectional shape and enters between said two slide plates, and slides along said shaft member; and operation rods, each being fitted at the lower end portion thereof into said key groove of said shaft member while penetrating longitudinally through said portion of said operation plate having a semi-circular sectional shape, each of said operation rods being equipped at an upper end portion thereof with a knob projection from said elongated hole of said cylindrical cover, wherein when said knob of said knob mechanism is pushed, said piece elevation lever connected to said pushed knob rotates and said member piece at the outer end portion of said piece elevation lever rotated by said pushed knob fits into said piece guide groove of said upper guide plate, and when said knob is pulled, said piece elevation lever connected to said pulled knob rotates and said member piece at the outer end portion of said piece elevation rotated by said pulled knob fits into said piece guide groove of said upper guide plate.

* * * * *